US007081075B2

(12) United States Patent
Sachs

(10) Patent No.: US 7,081,075 B2
(45) Date of Patent: Jul. 25, 2006

(54) RECREATIONAL BALANCING APPARATUS

(76) Inventor: Matthew Sachs, 8 Okanagan Drive, Ottawa (CA) K2H 7E8

( * ) Notice: Subject to any disclaimer, the term of this patent is extended or adjusted under 35 U.S.C. 154(b) by 214 days.

(21) Appl. No.: 10/195,927

(22) Filed: Jul. 16, 2002

(65) Prior Publication Data

US 2003/0017922 A1 Jan. 23, 2003

(30) Foreign Application Priority Data

Jul. 23, 2001 (CA) ..... 2353663

(51) Int. Cl.
*A63B 22/14* (2006.01)

(52) U.S. Cl. ..... 482/147; 482/34; 482/146

(58) Field of Classification Search ..... 482/146–147, 482/34, 148, 121–130, 70–71, 77–80; 446/325–6; D21/686–689; 472/1, 105
See application file for complete search history.

(56) References Cited

U.S. PATENT DOCUMENTS

| | | | | | |
|---|---|---|---|---|---|
| 145,145 | A | * | 12/1873 | Baggs | 119/69.5 |
| 2,707,465 | A | * | 5/1955 | Nemeth | 601/87 |
| 4,107,830 | A | * | 8/1978 | Thomson | 29/110.5 |
| 4,186,920 | A | * | 2/1980 | Fiore et al. | 482/79 |
| 4,337,939 | A | * | 7/1982 | Hoyle et al. | 482/79 |
| 4,505,477 | A | | 3/1985 | Wilkinson | |
| 4,605,220 | A | * | 8/1986 | Troxel | 482/79 |
| 4,739,986 | A | * | 4/1988 | Kucharik et al. | 482/79 |
| 4,826,159 | A | * | 5/1989 | Hersey | 272/146 |
| 4,850,588 | A | | 7/1989 | Desjardins et al. | |
| 4,911,440 | A | | 3/1990 | Hyman et al. | |
| 5,190,506 | A | | 3/1993 | Zubik et al. | |
| 5,399,140 | A | * | 3/1995 | Klippel | 482/146 |
| 5,584,787 | A | | 12/1996 | Guidry | |
| 5,643,182 | A | * | 7/1997 | Engel | 601/119 |
| 5,730,690 | A | | 3/1998 | Guidry | |
| 6,017,297 | A | * | 1/2000 | Collins | 482/146 |
| 6,162,189 | A | * | 12/2000 | Girone et al. | 600/592 |
| 6,277,057 | B1 | * | 8/2001 | Hayden | 482/79 |

* cited by examiner

*Primary Examiner*—Lori Amerson
(74) *Attorney, Agent, or Firm*—Schmeiser, Olsen & Watts

(57) ABSTRACT

A recreational balancing apparatus comprises a frame defining a horizontal opening therein, and a balancing board mounted on a joint assembly in a manner which allows the balancing board to tilt in every direction, and be capable of 360° rotation. The apparatus further comprises an upstanding support post, the post being secured to a lower portion of the joint assembly, and a lower portion of the support post passes downwardly through the frame opening. Support legs are secured to the frame, and a collar, having an opening therein, is provided. A first set of high tension springs connects the collar to the frame, the springs each being connected to a periphery of the collar and an inside portion of the frame, so that the collar is supported centrally within the horizontal frame opening, to provide a stable center for the support post to slide through, and achieve limited tiltable movement in a radial axis about a center of rotation positioned in the center of the collar. A second set of high tension springs or high elastic shock modulus cords each has a first end mounted to a side of the frame and a second end attached to a bottom portion of the support post, whereby the second set of high tension springs supports the bottom of the post and permits limited movement thereon, in a vertical direction.

19 Claims, 5 Drawing Sheets

RECREATIONAL BALANCING APPARATUS

This invention relates to a recreational balancing apparatus capable of 360° rotation, and more particularly to a recreational balancing apparatus that provides an individual with an expanded range of motion, both vertically and horizontally, and the means to shift his or her weight to maintain balance to tilt the balancing board, utilizing yaw and pitch motion, in every direction.

Participants in board sports, particularly snow boarders, surfers and skateboarders, may require many hours of practice to improve their balancing skills and the utilization of balancing apparatuses to improve their balancing, edging, banking and/or steering anticipation skills is preferable, as these can be used indoors or at a training facility. Balancing apparatuses can also be used to teach people better balance, or as a recreational activity for enhancing physical fitness. These apparatuses can further be utilized as an amusement device to see how long people can remain on the balancing apparatus while it is tilting.

DESCRIPTION OF THE PRIOR ART

Balancing board apparatuses have been utilized for recreational purposes and for teaching people balancing, proper edging and banking techniques and/or body weight equilibrium techniques relating to many sports activities. Therefore, balancing board apparatuses are in public demand because they allow a person to improve balance, are enjoyable to use and may be sufficiently small for home use and accessibility. In regard to this, there are numerous examples of existing balancing board devices.

Examples of such devices are disclosed in U.S. Pat. Nos. 2,764,411 and 3,995,858, which describe devices having a roller base section over which a board is positioned. The individual using the device will center the board over the roller base and use his or her skills to try to maintain their balance by shifting their weight over the roller. However, these types of balance devices are limited in the range of motions that they can provide, and they may also have structural limitations which would provide stability problems and limits of motion brought on by the structure of these devices.

Another prior art balancing board is described in U.S. Pat. No. 4,505,477, wherein the balancing board moves in a linear direction on top of two wheels, but does not, however, include a pivotal vertical axis of rotation or a radial horizontal axis of rotation.

U.S. Pat. No. 4,850,588 discloses a balancing apparatus for a surf board, which provides for a surf board to be tilted relatively to a support post about two different axes passing through the center of the support post. However, this balancing apparatus, while able to provide a wide range of horizontal motion relative to the support post, does not provide a user with both a horizontal and vertical range of motion.

SUMMARY OF THE INVENTION

It is therefore an object of the present invention to provide a recreational balancing apparatus capable of 360° rotation of the balancing board and having the means to shift the weight of a user to maintain balance to tilt the balancing board, utilizing yaw and pitch motion, in every direction, the apparatus being comparable to, for example, sports such as snow boarding or surfing, and which is enjoyable and challenging to utilize as a recreational activity.

Another object of the present invention is to provide a recreational balancing apparatus which is inexpensive to manufacture, can be utilized indoors or outdoors, and which can also provide a balancing apparatus to assist in improving a person's balancing, turning, banking, edging and other athletic skills.

Accordingly, one aspect of the present invention provides a recreational balancing apparatus comprising a balancing board upon which a person can stand; a frame having a horizontal opening therein; a support structure secured to the frame, the support structure having a lower end for resting on a surface on which the frame is supported; an upstanding support post, the support post having a lower portion passing downwardly through the frame opening; a joint assembly connecting a bottom surface of the balancing board to an upper portion of the support post; restraining means having an opening therein for receiving the support post, wherein the restraining means permits limited tilting movement of the support post in a radial axis about a center of rotation, the center of rotation being positioned in a center of the restraining means; first attachment means for connecting the restraining means to the frame, whereby the restraining means is supported centrally within the frame opening; and second attachment means secured to the frame and to the support post, the second attachment means permitting limited vertical movement of the support post within the restraining means.

According to a second aspect of the present invention, there is provided a recreational balancing apparatus comprising a balancing board upon which a person can stand; a frame having a horizontal opening therein; a support structure secured to the frame, the support structure having a lower end for resting on a surface on which the frame is supported; an upstanding support post, the support post having a lower portion passing downwardly through the frame opening; a joint assembly connecting a bottom surface of the balancing board to an upper portion of the support post; restraining means having an opening therein for receiving the support post whereby the restraining means permits limited tilting movement of the support post in a radial axis about a center of rotation, the center of rotation being positioned in a center of the restraining means; first attachment means for connecting the restraining means to the frame, wherein the first attachment means includes a first plurality of high tension springs, each of the first plurality of high tension springs having a first end connected to the restraining means, and a second end attached to an inside portion of the frame, whereby when the position of the restraining means has been displaced, the first plurality of high tension springs provides a restoring force for returning the restraining means, and the support post within, to a center position within the frame opening; and second attachment means, the second attachment means including a second plurality of high tension springs, the second plurality of high tension springs each having a first end mounted to a side of the frame and a second end attached to a bottom portion of the support post, whereby the support post is supported by the second plurality of high tension springs, and the second plurality of high tension springs permits limited vertical movement of the support post within the restraining means.

According to a third aspect of the present invention, there is provided a recreational balancing apparatus comprising a balancing board upon which a person can stand; a frame having a horizontal opening therein; a support structure secured to the frame, the support structure having a lower end for resting on a surface on which the frame is supported;

an upstanding support post, the support post having a lower portion passing downwardly through the frame opening; a joint assembly connecting a bottom surface of the balancing board to an upper portion of the support post; restraining means having an opening therein for receiving the support post whereby the restraining means permits limited tilting movement of the support post in a radial axis about a center of rotation, the center of rotation being positioned in a center of the restraining means; first attachment means for connecting the restraining means to the frame, wherein the first attachment means includes a first plurality of high tension springs, each of the first plurality of high tension springs having a first end connected to the restraining means, and a second end attached to an inside portion of the frame, whereby when the position of the restraining means has been displaced, the first plurality of high tension springs provides a restoring force for returning the restraining means, and the support post within, to a center position within the frame opening; and second attachment means, the second attachment means including a second plurality of high tension springs, the second plurality of high tension springs each having a first end mounted to a side of the frame and a second end attached to a bottom portion of the support post, whereby the support post is supported by the second plurality of high tension springs, and the second plurality of high tension springs permits limited vertical movement of the support post within the restraining means; and wherein the joint assembly allows the balancing board to rotate in any direction throughout the 360° range, and further comprises a bearing portion having an upper portion and a recessed portion at a lower end, a connector portion seated within a universal joint, and a spring member, wherein an upper end of the bearing portion is connected to a bottom surface of the fastening plate, and the recessed portion at the lower end of the bearing portion is rotatably disposed upon an upper surface of the connector, and a lower surface of the connector being seated within a top portion of the universal joint, the universal joint being disposed upon the upper portion of the support post, wherein the spring member is positioned coaxially around the universal joint, so that a lower end of the spring member rests upon the upper portion of the support post, so as to facilitate the joint assembly permitting the balancing board to be tilted in any direction by a user, wherein when the position of the balancing board has been displaced, the joint assembly provides a correcting force for returning the balancing board to an upright, substantially horizontal position after use.

The recreational balancing apparatus of the present invention differs from other balancing apparatuses in the following ways:

1. It is designed to provide a device that is economical, functional, portable, durable and, most importantly, enjoyable to use.

2. It is designed to allow for 360° of rotation, and can support the dynamic loading of the rider. The system is also designed to impart complete freedom of travel to the user in whichever direction he/she chooses, both in the horizontal and vertical directions. The ability of the apparatus of the present invention to move vertically is lacking from other prior art balancing devices.

3. The use of high tension springs or high elastic modulus shock cords to restrain a collar in the center of the frame, through which the support post supports the board will slide up and down and pivot about, provides a stable center for the apparatus, and is supplemented by supporting the bottom of the support post by another set of high tension springs or high elastic modulus shock cords. Such a design is simple, efficient and allows for modification and easy part replacement.

In its simplestform, the recreational balancing apparatus of the present invention has a balancing board upon which a person can stand. A frame, having a horizontal opening therein, is mounted upon a support structure, the support structure, which can consist of support legs, having a lower end for resting on a surface on which the frame is supported. An upstanding support post is placed within the frame opening, whereby a lower portion of the post passes downwardly through the frame opening, and a joint assembly connects the bottom surface of the balancing board to an upper portion of the support post. Restraining means, having an opening therein, receive within the opening the upstanding support post, wherein the restraining means permits limited tilting movement of the support post in a radial axis about a center of rotation, the center of rotation being positioned in a center of the restraining means. These restraining means can be a rigid horizontally positioned collar, but may also be of various other shapes and sizes. For example, the restraining means could be an elongated tube having an opening at an upper end tapering outwardly, so long as the restraining means which is used restrains the support post within the frame opening to permit limited tilting movement of the support post in a radial axis about a center of rotation. High tension springs are used to connect the collar to the frame, wherein the restraining means, or collar, is supported centrally within the frame opening, and a second set of high tension springs or high elastic shock modulus cords are secured to the frame and to the bottom of the support post, so that the second set of high tension springs or high elastic shock modulus cords permits limited vertical movement of the support post within the restraining means, or collar.

It should be noted that the present invention can adapt to the use of differing types and shapes of balance boards, including board types and shapes commonly used in sports such as snow boarding or skateboarding or, for example, boards where the balancing board has front and rear portions that are curved upwardly from the main body portion. The present invention could also have variations providing handles on the apparatus, which may help the rider mount the balancing board, or, for an expert user, may assist in performing extravagant balancing moves, or may further include having boards which are replaceable and adjustable.

The support post is an elongated post which can have circumferences of various sizes, but which should have a circumference large enough, and strong enough to ably support the weight of a rider using the apparatus. The top portion of the post can include, at an upper end of the post, a raised portion having a circumference different from that of the elongated body of the support post, whereby the universal joint and spring, or connector, can be more easily received. For example, this raised portion could have a smaller circumference than that of the main support post, in order that the smaller circumference of the raised portion could be received within the lower portion of the universal joint, and the spring would accordingly rest upon the larger circumference of the upper portion of the support post. The support post can also include a stopper portion attached to the support post, whereby the upward or downward movement of the spring member residing on the support post can be restricted by the stopper portion. This stopper portion may be shaped and formed as an integral part of the support post, but may also be connected to the post as, for example, a rubber connection piece secured to the post.

The apparatus also includes a joint assembly connected between the balancing board and the post for tilting the balancing board on the post about first and second axes passing through the center of the joint assembly. The first axis is preferably horizontal and located in the vertical plane containing the longitudinal axis of the balancing board. The second axis is located transverse to the first axis and is also preferably horizontal. Thus, the joint assembly can provide a side to side yawing motion to the balancing board on the support post about the first axis and also provides fore-and-aft pitching motion to the balancing board on the support post about the second axis. The joint assembly, depending upon the actions of the rider using the apparatus, can also be operated to simultaneously combine the yawing and pitching motions.

The joint assembly of the present invention allows the balancing board to rotate in any direction throughout the 360° range, and the joint assembly further comprises a bearing portion, a connector, which is mounted upon a universal joint, and a spring. An upper end of the bearing portion is connected to the bottom surface of the fastening plate, and the lowerend of the bearing portion is rotatably disposed upon the connector. The connector preferably has a longitudinally positioned middle segment, with upper and lower segments mounted on the top and bottom, respectively, of the middle segment, so that these upper and lower segments are in transverse relation to the middle segment. The connector is then mounted on top of the universal joint, so that the connector is effectively positioned between the universal joint and the bearing, with the upper and lower segments of the connector receivable within the bearing and the universal joint, respectively. The spring member is positioned coaxially around the universal joint, so that a lower end of the spring member rests upon the upper portion of the support post extending beyond the circumference of the support post, so as to facilitate the joint assembly permitting the user to return the board to a horizontal position, in that when the position of the balancing board has been displaced, the joint assembly provides a correcting force for returning the balancing board to an upright, substantially horizontal position after use. In another variation, the joint assembly may not have a universal joint at all, and would consist of a bearing portion, a connector, and a spring. In this variation of the joint assembly an upper portion of the bearing is connected to the bottom surface of the fastening plate underneath the balancing board, and the lower end of the bearing portion is rotatably disposed upon the connector. The connector is then mounted on top of the support post, with a lower segment of the connector extending downwardly into the support post such that the lower segment of the connector is positioned coaxially within the support post. Possibly, the lower segment of the connector could also have a rounded edge to roll on the support post in response to the demands placed upon the balancing apparatus by a user. A spring member would then be fitted coaxially around the upper portion of the support post where the connector is attached to the support post, so as to help create a restoring, correcting force for the yaw and pitch motions of the board, to assist the user in returning the board to a horizontal position.

As noted above, since the balancing board is able to rotate through 360°, the joint assembly directly below the board must allow the rider to counter horizontal momentum by adjusting the position of the board. By allowing the rider to manipulate the position of the board with their ankles and legs to rotate the plane of the board so that it always faces towards a center point, the rider can respond quickly and efficiently to regain balance. This freedom of movement in the board is essential to simulate the feeling of free-riding.

The high tension springs, which are used to suspend the collar within the frame opening, and to attach and support the bottom of the support post to the frame, can cover substantially all of the space between the collar and the frame. It is preferable to use high tension springs to suspend the collar within the frame opening and high elastic modulus shock cords to support and connect the bottom of the support post to the frame, but other high strength cords of resilient composition can also be used. It is also possible to use either the high tension springs or the high elastic modulus shock cords to both suspend the collar within the frame opening and support and connect the bottom of the support post to the frame. The high tension springs restraining the collar in the center of the frame are designed to provide progressive resistance against momentum created as the user tilts the support post away from the vertical axis. This will aid the rider in returning to an upright position, and will allow a more experienced rider the challenge of "working against" this resistance to push the limits of the apparatus. Similarly, the resistance to motion along the vertical axis will help a beginner by limiting their motion. The collar of the present invention can include a bushing provided on an interior surface of the collar, whereby the vertical movement of the support post within the collar opening can be guided, or to ease any friction involved in the support post moving up and down. The collar also provides for securing hooks to be positioned on a periphery of the collar, whereby the first end of each of the first plurality of high tension springs is connected to the securing hooks on the periphery of the collar, and the second end of each of the first plurality of high tension springs is connected to the securing hooks on the interior portion of the frame. The high tension springs can be provided with hooked portions, so as to engage the securing hooks on the frame and/or collar. It is also possible to weld metal rings around the collar instead of using securing hooks, with the metal rings themselves having receiving openings wherein the first end of each of the first plurality of high tension springs or high elastic shock modulus cords may be connected to the rings welded on the periphery of the collar.

The frame of the present invention includes a number of equally spaced corner pieces mounted to the frame, and each of the corner pieces defines an internal channel within. The corner pieces are preferably welded to the frame, which minimizes weight and maximizes strength, by eliminating any attachment materials. The internal channels of the corner pieces are threaded and positioned angularly in relation to the frame, so that the upper ends of the support legs are matingly threaded and secured to the internal channel of each of the plurality of corner pieces. The support legs then extend angularly out from the frame to provide a solid base for supporting the apparatus on the surface on which the apparatus is resting. In providing this solid base of support, the support legs are connected to the frame at equally spaced angles around the support post, and are preferably made of aluminum, but it should be noted that other rigid materials may be used in the support leg construction. The lower ends of the plurality of support legs can also be adapted to receive a frictional support attachment, such as rubber "feet", the frictional support attachments being used to deter the apparatus from shifting position during use by the rider. The frame base may be supported by three support legs, as a tripod frame, but it is possible to have, for example, four or five sided frames, having four or five corresponding support legs.

Numerous alternative embodiments of the present invention can also be effected. For example, the frame can be composed of interconnected pieces or plates that are welded or secured together, or the frame may be a one-piece frame made by, for example, injection molding or sandcasting. To increase the portability and transportability of the apparatus, it is also possible and conceivable that holes could be drilled in frame portions, to reduce the total weight of the apparatus. The apparatus can also, if necessary, be modified and mounted in a pool or other body of water, using the balancing board as a platform. The tilting motion of the balancing board, while in use, can approximate the motion, for example, a surfer would encounter surfing, and thus the apparatus can also be used to teach people how to balance on a surfboard. Of course, should a user fall from the balancing apparatus, the water surrounding the balancing board acts as a natural safety cushion to deter injuries to the user. It is also possible that no support legs are necessary for the frame to rest upon, such as in modifications where the frame is bolted or secured to a floor surface, or to the bottom of a pool. In such an embodiment as this however, a recessed floor or pool bottom area would need to be provided under the frame to accommodate the vertical motion of the support post within the frame. It is also possible that a collar could be suspended in a circular opening on a floor or the bottom of a pool, and the support post then received within the collar, thus dispensing of the frame altogether.

BRIEF DESCRIPTION OF THE DRAWINGS

Embodiments of the present invention will be further described with reference to the accompanying drawings, in which.

DETAILED DESCRIPTION OF THE DRAWINGS

Figure 1:
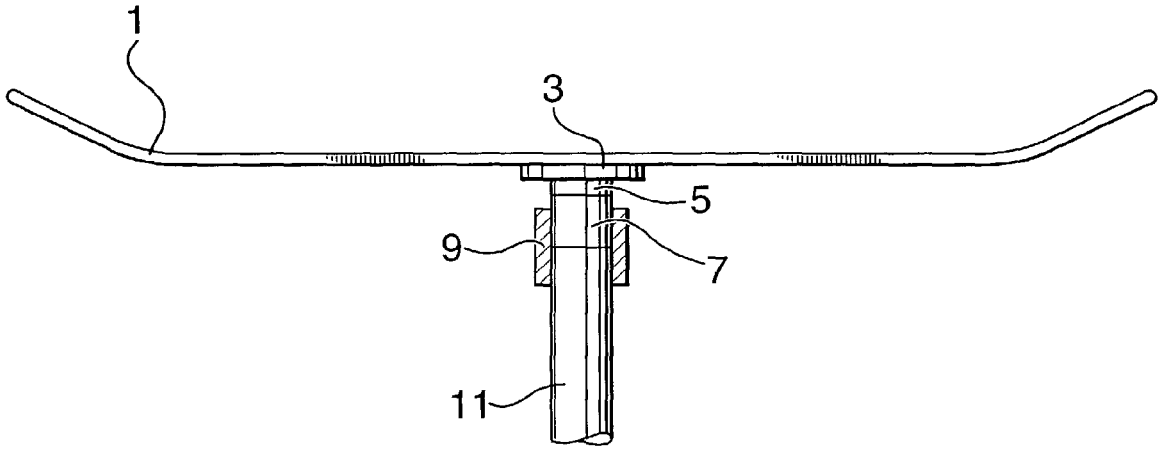
FIG. 1 is a partial side view of a top portion of the balancing apparatus of the present invention, illustrating an embodiment of the joint assembly.

Illustrated in FIG. 1 is a partial side view of the upper portion of the recreational balancing apparatus of the present invention, the apparatus comprising a platform or balancing board (1) mounted on top of a fastening plate (3). A bearing portion (5) is connected at an upper end to a bottom of the fastening plate (3), and a lower end of the bearing portion (5) is connected to, and rotatable upon, a connector (7), the connector (7) being secured within an upper portion of the support post (11). A spring member (9), the spring member defining an internal passageway therein, would then be fitted coaxially around the upper portion of the support post (11), whereby the connector (7) and support post (11) at least partially reside coaxially within the internal passageway of the spring member (9), in order to provide a user with a restoring, correcting force for the yaw and pitch motions of the board, to assist the user in returning the board to a horizontal position, and allowing the user of the apparatus to tilt the balancing board in any direction.

Figure 2:
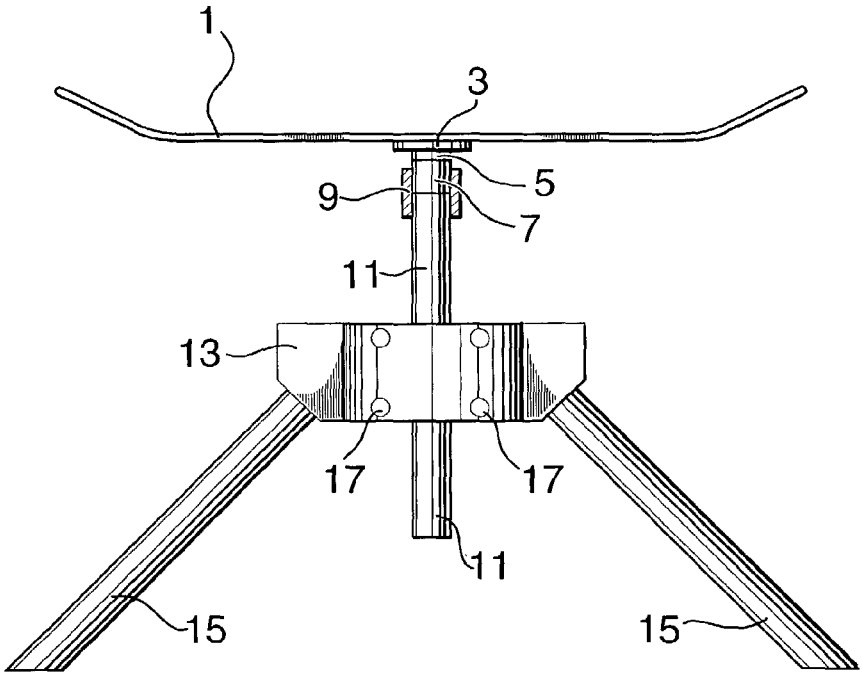
FIG. 2 is a side view of the balancing apparatus of the present invention illustrated in FIG. 1.

Illustrated in FIG. 2 is a full side view of the balancing apparatus of the present invention illustrated in FIG. 1, the apparatus comprising a platform or balancing board (1) mounted on top of a fastening plate (3). A bearing portion (5) is connected at an upper end to a bottom of the fastening plate (3), and a lower end of the bearing portion (5) is connected to, and rotatable upon, a connector (7), the connector (7) being secured within an upper portion of the support post (11). A spring member (9), the spring member defining an internal passageway therein, would then be fitted coaxially around the upper portion of the support post (11), whereby the connector (7) and support post (11) at least partially reside coaxially within the internal passageway of the spring member (9). A lower portion of the support post (11) passes downwardly through an opening in the center of the frame (13), the frame (13) being supported by a plurality of support legs (15), each of the legs having respective upper ends for being secured to the frame (13), and respective lower ends for resting on the surface on which the frame (13) is supported. This particular embodiment of the present invention illustrates holes (17) drilled into the frame, so as to help minimize the total weight of the apparatus and increase portability.

Figure 3:
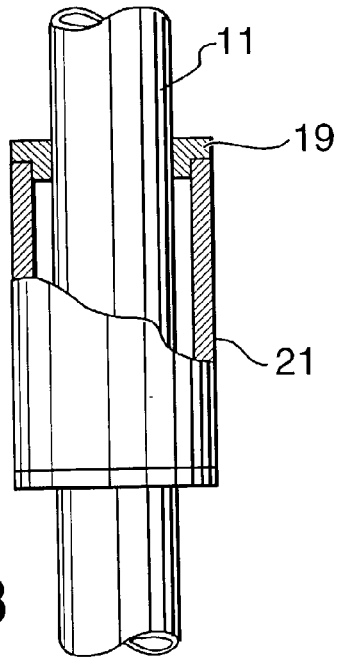
FIG. 3 is a side view broken away of the support post, illustrating an embodiment of the collar of the present invention, wherein a bushing is provided therein.

FIG. 3 provides a side view broken away of the support post (11), illustrating an embodiment of the present invention, wherein a bushing (19) is provided in the collar (21), the bushing being present to act as either a guide or to reduce friction for the support post (11) as it moves up and down within the collar (21).

Figure 4:
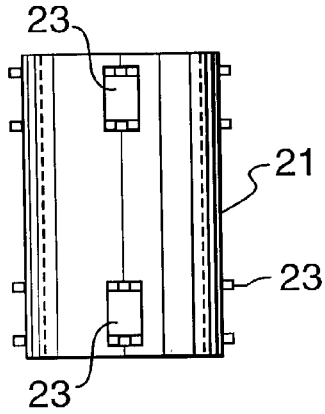
FIG. 4 is a side view of the embodiment of the collar shown in FIG. 3, wherein securing hooks are provided on the collar.

Referring to FIG. 4, a side view of the collar of the present invention is provided, illustrating one embodiment of the collar (21) having securing hooks (23) provided on the collar (21), whereby high tension springs may be attached in order to secure the collar (21) to the frame.

Figure 5:
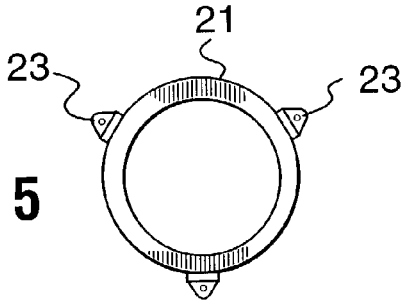
FIG. 5 is a top view taken of the embodiment of the collar illustrated in FIG. 4.

Referring to FIG. 5, there is provided a top view taken of the collar illustrated in FIG. 4, again illustrating one embodiment of the collar (21) wherein securing hooks (23) are positioned on the periphery of the collar (21).

Figure 6:
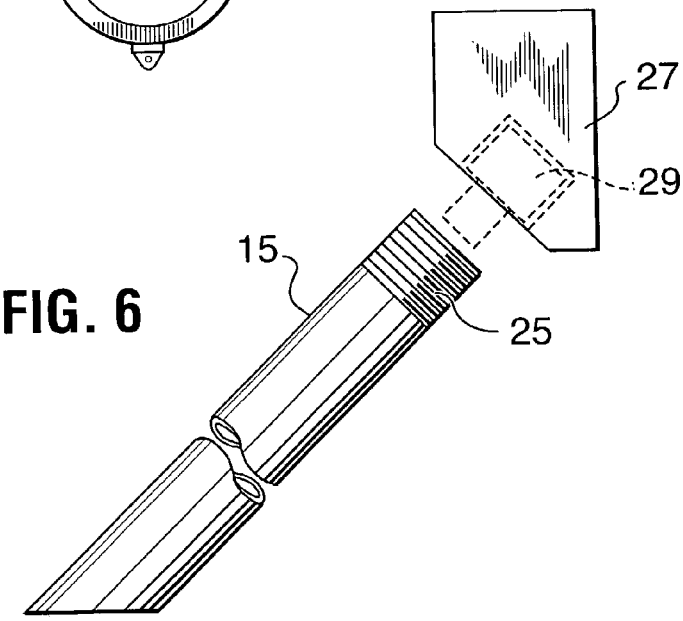
FIG. 6 is a diagram of one of the support legs of the present invention, illustrating the threaded upper portion of the support leg, and the corner piece within which the support leg is mated with and secured to the frame.

Referring to FIG. 6, is a diagram of one of the support legs of the present invention, illustrating a threaded upper portion (25) of the support leg, and one of the equally spaced corner pieces (27) mounted to the frame. Each of the corner pieces (27) defines an internal channel (29) therewithin, the internal channel (29) being threaded and positioned angularly in relation to the frame and the corner piece (27). The upper ends of each of the support legs (15) are matingly threaded within and secured to the internal channel (29) of each of the corner pieces (27), and when secured, the support legs (15) extend angularly out from the frame to provide a solid base for supporting the apparatus on the surface on which the apparatus is resting.

Figure 7:
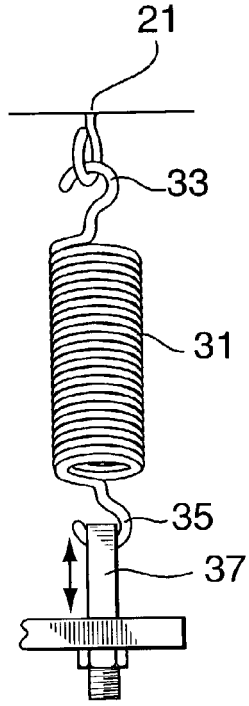
FIG. 7 is a side perspective view of one of the high tension springs of one embodiment of the present invention, illustrating the high tension spring connected to the collar and the frame.

Referring to FIG. 7 is a side perspective view of one embodiment of the high tension springs (31) of the present invention, illustrating the high tension spring (31) being connected to the collar (21) and the frame. Each of the plurality of high tension springs (31) has a first end (33) connected to the collar (21), and a second end (35) attached to an inside portion (37) of the frame, whereby the collar (21) can be supported centrally within the frame opening. In the embodiment shown, the spring is adjustable, whereby the distance between the inside portion of the frame (37), and the second end of the spring (35) may be increased or reduced, to accordingly increase or reduce the tension of the springs connected to the collar (21) and the inside portion (37) of the frame.

Figure 8:
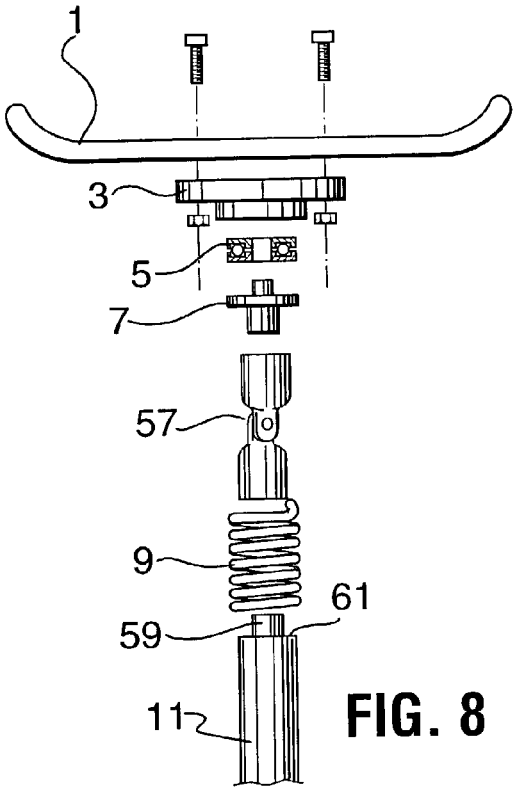
FIG. 8 is an exploded side view of the components of one embodiment of the joint assembly of the present invention.

Referring to FIG. 8 is an exploded side view of the components of the joint assembly of the present invention, illustrating a platform or balancing board (1) mounted on top of a fastening plate (3). A bearing portion (5) is connected at an upper end to a bottom of the fastening plate (3), and a lower end of the bearing portion (5) is connected to, and rotatable upon, a connector (7), the connector (7) being secured and mounted on top of the universal joint (57). The connector (7) is effectively positioned between the universal joint (57) and the bearing portion (5), with upper and lower segments of the connector (7) receivable within the bottom of the bearing portion (5) and the top of the universal joint (57), respectively. The universal joint (57) is disposed upon the upper portion of the support post (11). In this embodiment, a raised portion of the support post (59) having a circumference different from that of the elongated body of the support post (11) is received within the lower portion of the universal joint (57), and the spring (9) is positioned coaxially around the universal joint (57), so that a lower end of the spring member (9) rests upon the larger circumference (61) of the upper portion of the support post (11), the spring helping to create a restoring, correcting force for the yaw and pitch motions of the board, and to assist the user in returning the board to a horizontal position.

Figure 9:
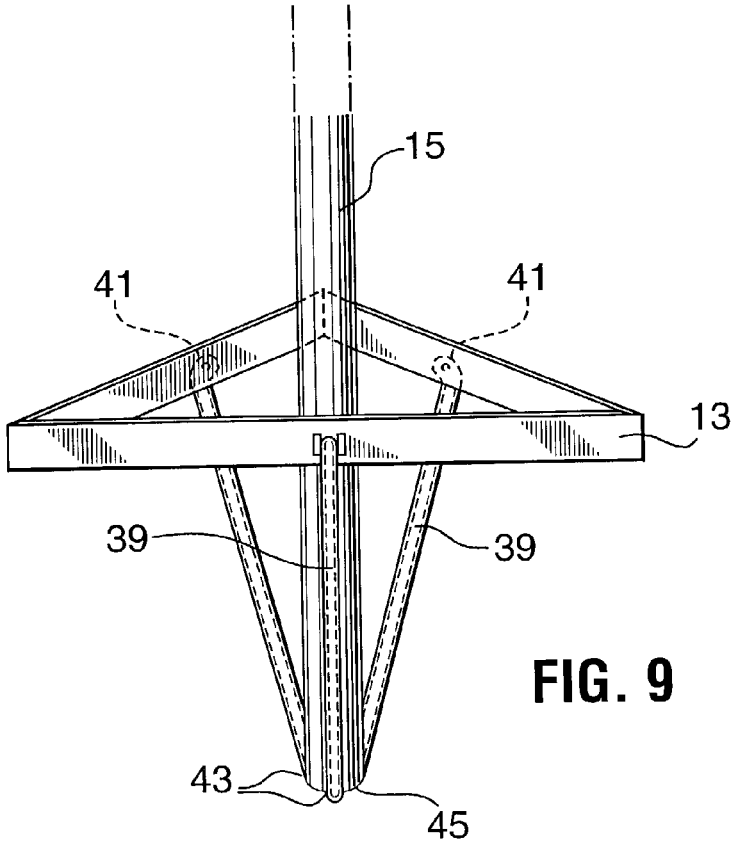
FIG. 9 is a side perspective view of the second attachment means of the present invention, the high tension springs being connected to the frame and to the bottom of the support post.

Referring to FIG. 9 is a side perspective view of another embodiment of the present invention, illustrating a second set of high tension springs (39) being connected to the frame (13) and to the bottom of the support post (45). The second set of high tension springs (39) each has a first end (41) mounted to a side of the frame (13) and a second end (43) attached to a bottom portion of the support post (45).

Figure 10:
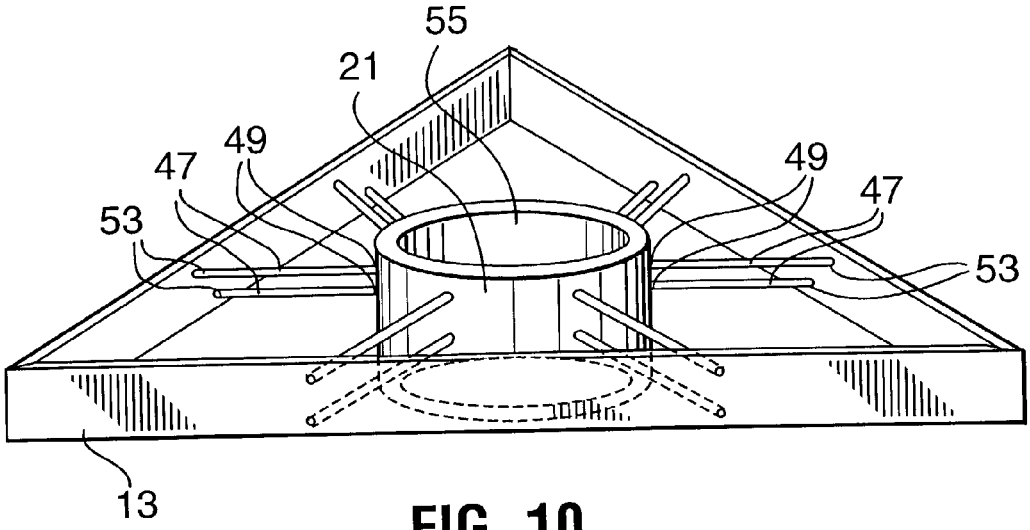
FIG. 10 is a side perspective view of the attachment means of the present invention, illustrating one embodiment of a collar being supported by a plurality of high tension springs in the center of the frame.

Referring to FIG. 10, there is provided a side perspective view of one embodiment of the present invention, illustrating the collar (21) being supported by a first set of high tension springs (47) in the center of the frame (13). Each of the first set of high tension springs (47) has a first end (49) connected to the collar (21), and a second end (53) attached to an inside portion of the frame (13), whereby the collar (21) is supported centrally within the frame opening, and the support post can be received within the opening (55) of the collar, wherein when the position of the collar (21) has been displaced during use by a rider, the first plurality of high tension springs provides a restoring force for returning the collar (21), and the support post (11) received therein, to a center position within the frame opening after use.

Figure 11:
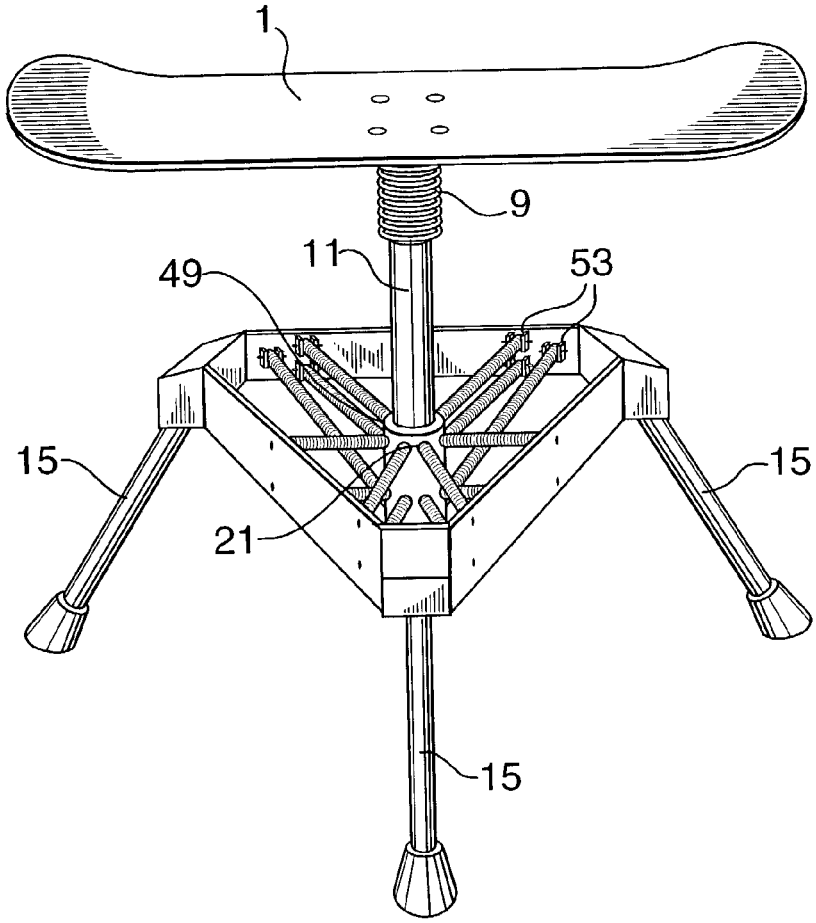
FIG. 11 is a top perspective view of the present invention.

FIG. 11 is a top perspective view of the recreational balancing apparatus of the present invention illustrating the balancing board (1) on which a person can stand, the frame (13) having a central opening therein, and the spring member (9). An upper portion of the support post (11) is secured to a lower portion of the spring member (9), and a lower portion of the support post (11) passes downwardly through an opening in the frame. This illustration also shows the upstanding support post (11) passing downwardly, in its operative state, through the opening of the collar (21). The apparatus further includes a plurality of support legs (15), each of the legs (15) having upper ends for being secured to the frame (13), and lower ends for resting on the surface on which the frame (13) is supported. A first plurality of high tension springs is also shown, each of the plurality of high tension springs having a first end (49) connected to the collar (21), and a second end (53) attached to an inside portion of the frame.

Figure 12:
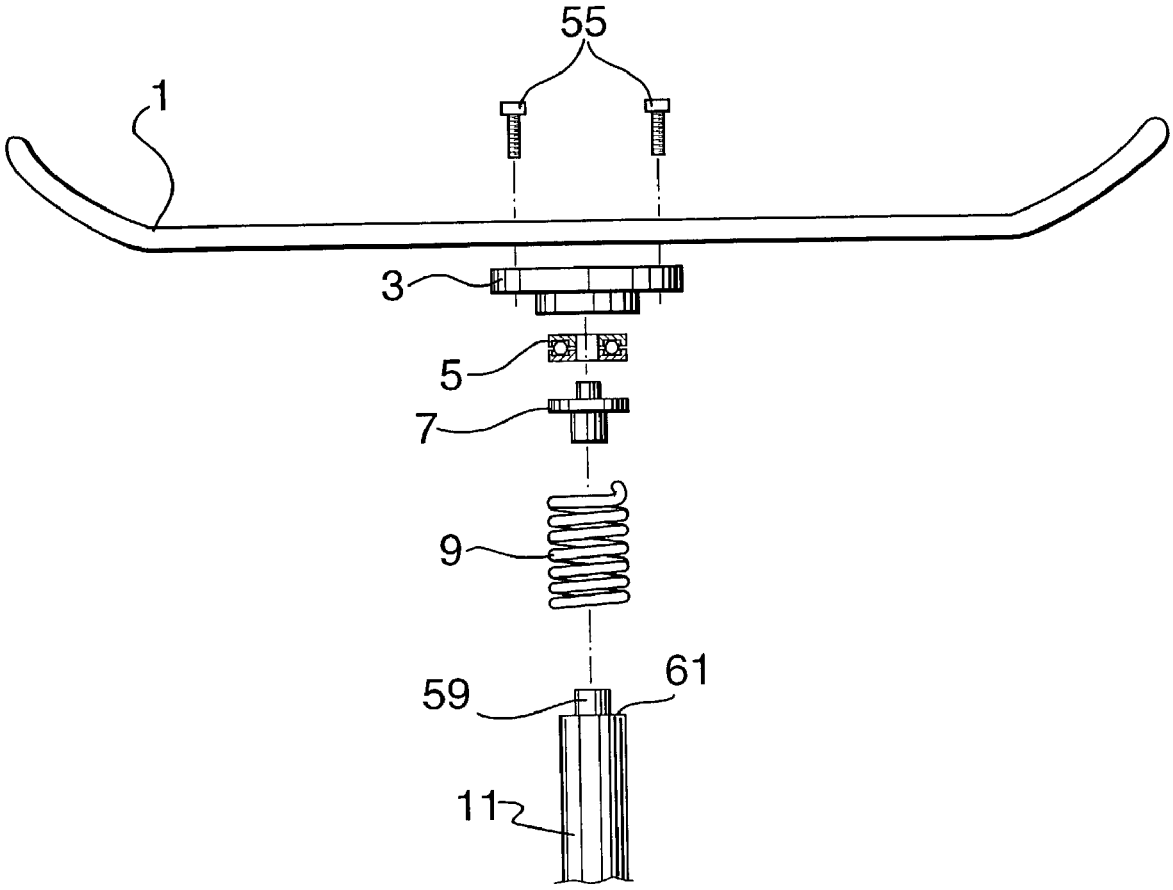
FIG. 12 is an exploded side view of a second embodiment of the joint assembly illustrated in FIG. 1.

Referring to FIG. 12, there is provided an exploded side view of a second embodiment of the joint assembly of the present invention, illustrating a platform or balancing board (1) mounted on top of a fastening plate (3). Screws (55) can be used to secure the board to the fastening plate (3). A bearing portion (5) is connected at an upper end to a bottom of the fastening plate (3), and a lower end of the bearing portion (5) is connected to, and rotatable upon, a connector (7), the connector (7) being secured within, in this embodiment, a raised portion (59) on the support post having a smaller circumference different from that of the elongated body of the support post (11). A spring member (9), the spring member (9) defining an internal passageway therein, would then be fitted coaxially around the upper portion of the support post to rest upon the larger circumference (61) of the upper portion of the support post (11) so that the raised portion of the support post (59) at least partially resides within the spring (9), so as to help create a restoring, correcting force for the yaw and pitch motions of the board, to assist the user in returning the board to a horizontal position.

I claim:

1. A recreational balancing apparatus comprising:

a balancing board upon which a person can stand with two feet;

a frame having a horizontal opening therein;

a support structure secured to the frame, the support structure having a lower end resting on a surface on which the frame is supported;

an upstanding support post, the support post having a lower portion passing downwardly through the frame opening;

a joint assembly connecting a bottom surface of the balancing board to an upper portion of the support past;

restraining means having an opening therein for receiving the support post, whereby the restraining means permits limited tilting movement of the support post in a radial axis about a center of rotation, the center of rotation being positioned in a center of the restraining means;

first attachment means connecting the restraining means to the frame, wherein the restraining means is supported centrally within the frame opening; and second attachment means connecting the frame to the support post, wherein the second attachment means permits limited vertical movement of the support post within the restraining means when the apparatus is in use.

2. The recreational balancing apparatus of claim 1, wherein the first attachment means includes a first plurality of high tension springs, each of the first plurality of high tension springs having a first end connected to the restraining means, and a second end attached to an interior portion of the frame, whereby when the position of the restraining means has been displaced, the first plurality of high tension springs provides a restoring force for returning the restraining means, and the support post received within, to a center position within the frame opening after use.

3. The recreational balancing apparatus of claim 1, wherein the second attachment means includes a second plurality of high tension springs, the second plurality of high tension springs each having a first end mounted to a side of the frame and a second end attached to a bottom portion of the support post, whereby the support post is supported by the second plurality of high tension springs.

4. The recreational balancing apparatus of claim 2, further comprising a first set of securing hooks positioned on a periphery of the restraining means, whereby the first end of each of the first plurality of high tension springs are connected to the first set of securing hooks on the periphery of the restraining means.

5. The recreational balancing apparatus of claim 1, wherein the balancing board is connected to the upper portion of the joint assembly by a fastening plate.

6. A recreational balancing apparatus comprising:

a balancing board upon which a person can stand;

a frame having a horizontal opening therein;

a support structure secured to the frame, the support structure having a lower end for resting on a surface on which the frame is supported;

an upstanding support post, the support post having a lower portion passing downwardly through the frame opening;

a joint assembly connecting a bottom surface of the balancing board to an upper portion of the support post;

restraining means having an opening therein, for receiving the support post, whereby the restraining means permits limited tilting movement of the support post in a radial axis about a center of rotation, the center of rotation being positioned in a center of the restraining means;

first attachment means for connecting the restraining means to the frame, whereby the first attachment means includes a first plurality of high tension springs, each of the first plurality of high tension springs having a first end connected to the restraining means, and a second end attached to an inside portion of the frame, whereby when the position of the restraining means has been displaced, the first plurality of high tension springs provides a restoring force for returning the restraining means, and the support post within, to a center position within the frame opening; and second attachment means, the second attachment means including a second plurality of high tension springs, the second plurality of high tension springs each having a first end mounted to a side of the frame and a second end attached to a bottom portion of the support post, whereby the support post is supported by the second plurality of high tension springs, and the second plurality of high tension springs permits limited vertical movement or the support post within the restraining means;

and wherein the joint assembly allows the balancing board to rotate in any direction throughout the 360° range, and further comprises a bearing portion having an upper portion and a recessed portion at a lower end, a connector portion sealed within a universal joint, and a spring member, wherein an upper end of the bearing portion is connected to a bottom surface of the fastening plate, and the recessed portion at the lower end of the bearing portion is rotatably disposed upon an upper surface of the connector, and a lower surface of the connector being scated within a top portion of the universal joint, the universal joint being disposed upon the upper portion of the support post, wherein the spring member is positioned coaxially around the universal joint, so that a lower end of the spring member rests upon the upper portion of the support post, so as to facilitate the joint assembly permitting the balancing board to be tilted in any direction by a user, wherein when the position of the balancing board has been displaced, the joint assembly provides a correcting force for returning the balancing board to an upright, substantially horizontal position after use.

7. The recreational balancing apparatus of claim 4, wherein the first attachment means include at least one hooked portion for engaging the first set of securing hooks on the periphery of the restraining means.

8. The recreational balancing apparatus of claim 1, wherein the support structure comprises a plurality o f support legs, each of the legs having respective upper ends for being secured to the frame, and respective lower ends for resting on a surface on which the frame is supported.

9. The recreational balancing apparatus of claim 1, wherein the frame further comprises a plurality of equally spaced corner pieces mounted to the frame, each of the corner pieces defining an internal channel therewithin, the internal channel being threaded and positioned angularly in relation to the frame.

10. The recreational balancing apparatus of claim 9, wherein the tipper ends of each of the plurality of support legs are matingly threaded within and secured to the internal channel of each of the plurality of corner pieces, and when secured, the support legs extend angularly out from the frame to provide a tripod base for supporting the apparatus on the surface on which the apparatus is resting.

11. The recreational balancing apparatus of claim 8, wherein the lower ends of the plurality of support legs can matingly receive a frictional support attachment, the frictional support attachment being able to deter the apparatus from shifting position during use.

12. The recreational balancing apparatus of claim 6, wherein the support post further comprises a stopper portion attached to the support post, whereby vertical movement of the spring member residing on the support post can be restricted by the stopper portion.

13. The recreational balancing apparatus of claim 2, wherein the restraining means further includes a bushing member provided on an interior surface of the restraining means.

14. The recreational balancing apparatus of claim 2, further comprising a second set of securing hooks positioned on the interior portion of the frame, whereby the second end of each of die first plurality of high tension springs is connected to the second set of securing hooks on the interior portion of the frame.

15. The recreational balancing apparatus of claim 1, wherein the frame includes a plurality or interconnected frame pieces.

16. The recreational balancing apparatus of claim 1, wherein the length of the first and the second attachment means is adjustable.

17. The recreational balancing apparatus of claim 6, wherein the support post includes a raised portion at an upper end of the support post, wherein the raised portion has a smaller circumference than a larger circumference of the support post, whereby the smaller circumference of the raised portion can be matingly received within the universal joint, and the spring accordingly rests upon the larger circumference of the support post.

18. The recreational balancing apparatus of claim 6, wherein the support post includes a raised portion at an upper end of the support post, whereby the raised portion has a smaller circumference than a larger circumference of the support post, whereby the smaller circumference of the raised portion can be matingly received within the connector, and the spring accordingly rests upon the larger circumference of the support post.

19. The recreational balancing apparatus of claim 2, wherein the restraining means further comprises ringed portions welded and positioned on a periphery of the restraining means, the ringed portions having a plurality of openings defined therein, whereby the first end of each of the first plurality of high tension springs are connected to the plurality of openings in the ringed portions.

* * * * *